US006076567A

United States Patent [19]

Naecker et al.

[11] Patent Number: 6,076,567

[45] Date of Patent: Jun. 20, 2000

[54] FILLING MACHINE ASSEMBLY

[75] Inventors: Jens Naecker, Hamburg; Wolfgang Wilke, Hoisdorf, both of Germany; Kecheng Ding, Titusville, Fla.

[73] Assignee: Crown Simplimatic Incorporated, Lynchburg, Va.

[21] Appl. No.: 09/272,485

[22] Filed: Mar. 19, 1999

Related U.S. Application Data

[60] Provisional application No. 60/116,464, Jan. 20, 1999.

[51] Int. Cl.[7] ..... B65B 31/00

[52] U.S. Cl. ..... 141/59; 141/44; 141/45; 141/47; 141/50; 141/59; 141/147; 141/192; 141/198; 141/285; 141/302; 141/308

[58] Field of Search ..... 141/39, 47, 50, 141/52, 57, 59, 144, 147, 192, 198, 285, 291, 296, 301, 302, 308, 45

[56] References Cited

U.S. PATENT DOCUMENTS

| | | |
|---|---|---|
| 3,595,280 | 7/1971 | Fissel . |
| 3,633,635 | 1/1972 | Kaiser . |
| 4,653,551 | 3/1987 | Sindermann . |
| 4,938,261 | 7/1990 | Petri et al. . |
| 5,000,234 | 3/1991 | Weiss . |

*Primary Examiner*—Timothy L. Maust
*Attorney, Agent, or Firm*—Howard & Howard

[57] ABSTRACT

A filling machine assembly (10) for filling a beverage container (12), such as a bottle or can, with a beverage, such as a carbonated drink, juice or water. The filling machine (10) includes a support housing (14) having an inner fluid chamber (20) for supplying the beverage to be discharged into the container (12). A valve housing (22) is mounted to the bottom of the support housing (14) for controlling the discharge of the beverage and a control device (24) is mounted to the top of the support housing (14). A vent tube (26) is actuated upward and downward via the control device (24) and extends into the valve housing (22). A support tube (34) extends between the control device (24) and the valve housing (22) and has a bore (36) surrounding the vent tube (26). An actuation device (42) moves the vent tube (26) within the bore (36) relative to the support tube (34) a predetermined stroke between a filling position and a non-use position. An upper tube seal (44) is in sealing engagement between the control device (24) and the vent tube (26) with the bore (36) of the support tube (34) open to the upper seal (44). A lower tube seal (46) is in sealing engagement between the support tube (34) and the vent tube (26) to seal the bore (36) of the support tube (34) between the upper (44) and lower (46) seals. The assembly is characterized by a chamber sealing mechanism (52) selectively sealing the bore (36) between the upper (44) and lower (46) tube seals from the inner fluid chamber (20) to equalize operating pressures against the upper (44) and lower (46) tube seals during the movement of the vent tube (26) between the filling and non-use positions.

26 Claims, 8 Drawing Sheets

116
108
110
114
112
118
24
84
104
28
10
86
102
84
42
106
88
44
82
44
16
32
40
54
76
52
62
78
14
70
36
78
80
20
72
120
34
30
26
36

116
112
108
114
110
84
24

104
84
10
86
28
102
42
88
44
82
106
44
16
40
32
54
52
62
78
70
20
80
36
14
76
120
72
34
30
31
36
26

FILLING MACHINE ASSEMBLY

RELATED APPLICATION

This patent application claims priority to and all the benefits of U.S. Provisional Patent Application No. 60/116,464, filed on Jan. 20, 1999 and entitled "Filling Machine Assembly".

BACKGROUND OF THE INVENTION

1) Technical Field

The subject invention relates to a beverage filling machine for filling a container with a liquid material, preferably a carbonated beverage.

2) Description of the Prior Art

Filling mechanisms used for filling containers, such as cans, jars, or bottles, with a beverage, such as carbonated drinks, juices, water or the like, as are well known in the art. Conventional filling mechanisms feed the containers into a star wheel conveyor which individually positions each container on a rotating turntable below a valve assembly of an individual filling machine. The container moves into sealing engagement with the valve assembly by either moving the container upwardly or by lowering the valve assembly. Modern filling machines are known in the art as counter pressure filling machines as is discussed below. There may be as many as 120 individual filling machines disposed circumferentially around the turntable. The filling machines typically include a support housing having an inner fluid chamber or ring bowl disposed above the valve assembly. The ring bowl is usually annular and contains the liquid or beverage for filling the containers and has a space above the liquid for a pressurized inert gas such as carbon dioxide or nitrogen. This space above the liquid is known as the headspace. A common storage tank or reservoir feeds the ring bowl with the required liquid and gas.

In the typical filling operation, the container, which is sealed against the valve assembly, is initially purged with the inert gas from the ring bowl for a predetermined time in order to flush air and other impurities from the container. A vent tube is introduced into the container to accomplish this an other operations. The liquid is filled into the container from the ring bowl while the gas from the container vents through the vent tube into the headspace. The liquid will at least partially rise into the vent tube during the filling of the container. The gas pressure in the container and the ring bowl are equalized when filling begins. This is what is known as counter pressure which allows the liquid to flow into the container solely under the influence of gravity. After the container is filled to a desired level, the vent tube rises out of the container. Finally, gas is released from the top of the container to the atmosphere by an process commonly known as "snifting".

The beverage filling industry continuously strives for machinery and methods which facilitate rapid, economical, efficient, and sterile filling of containers. As discussed above, methods and apparatuses for filling containers with carbonated liquids have evolved into counter pressure filling machines. These counter pressure filling machines typically operate under relatively high pressures. Many of the components of the filling machine are susceptible to excessive wear and damage from the pressures created within the inner fluid chamber. One such component is the vent tube which, as discussed above, moves in and out of the container during the filling operation. As appreciated, the vent tube is sealed from certain parts of the filling machine to effectuate its operation. These tube seals can experience significant pressure differentials which can significantly reduce the operating life of the seals. Accordingly, it is desirable to maintain substantially equal operating pressures on both sides of the tube seals during the movement of the vent tube.

SUMMARY OF THE INVENTION AND ADVANTAGES

A filling machine assembly for filling a container with a fluid material. The assembly comprises a support housing having an upper surface and a lower surface defining an inner fluid chamber for supplying the fluid material to be discharged into the container. A valve housing is mounted to the lower surface of the support housing for controlling the discharge of the fluid material. A control device is mounted to the upper surface of the support housing. A vent tube has a first end disposed within the control device and a second end extending into the valve housing. A support tube defines a through bore extending between the control device and the valve housing and surrounds the vent tube. An actuation device moves the vent tube within the bore relative to the support tube a predetermined stroke between a filling position and a non-use position. An upper tube seal is in sealing engagement between the control device and the first end of the vent tube with the bore of the support tube open to the upper seal. A lower tube seal is in sealing engagement between the support tube and the second end of the vent tube to seal the bore of the support tube between the upper and lower seals. The assembly is characterized by a chamber sealing mechanism for selectively sealing the bore between the upper and lower tube seals from the inner fluid chamber to equalize operating pressures against the upper and lower tube seals during the movement of the vent tube between the filling and non-use positions.

Accordingly, the subject invention equalizes pressure on both sides of the vent tube's seals which significantly extends the operating life of these seals. The pressure equalizing device of the subject invention is a relatively simple system which automatically operates in conjunction with the filling operation of the filling machine.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1A:
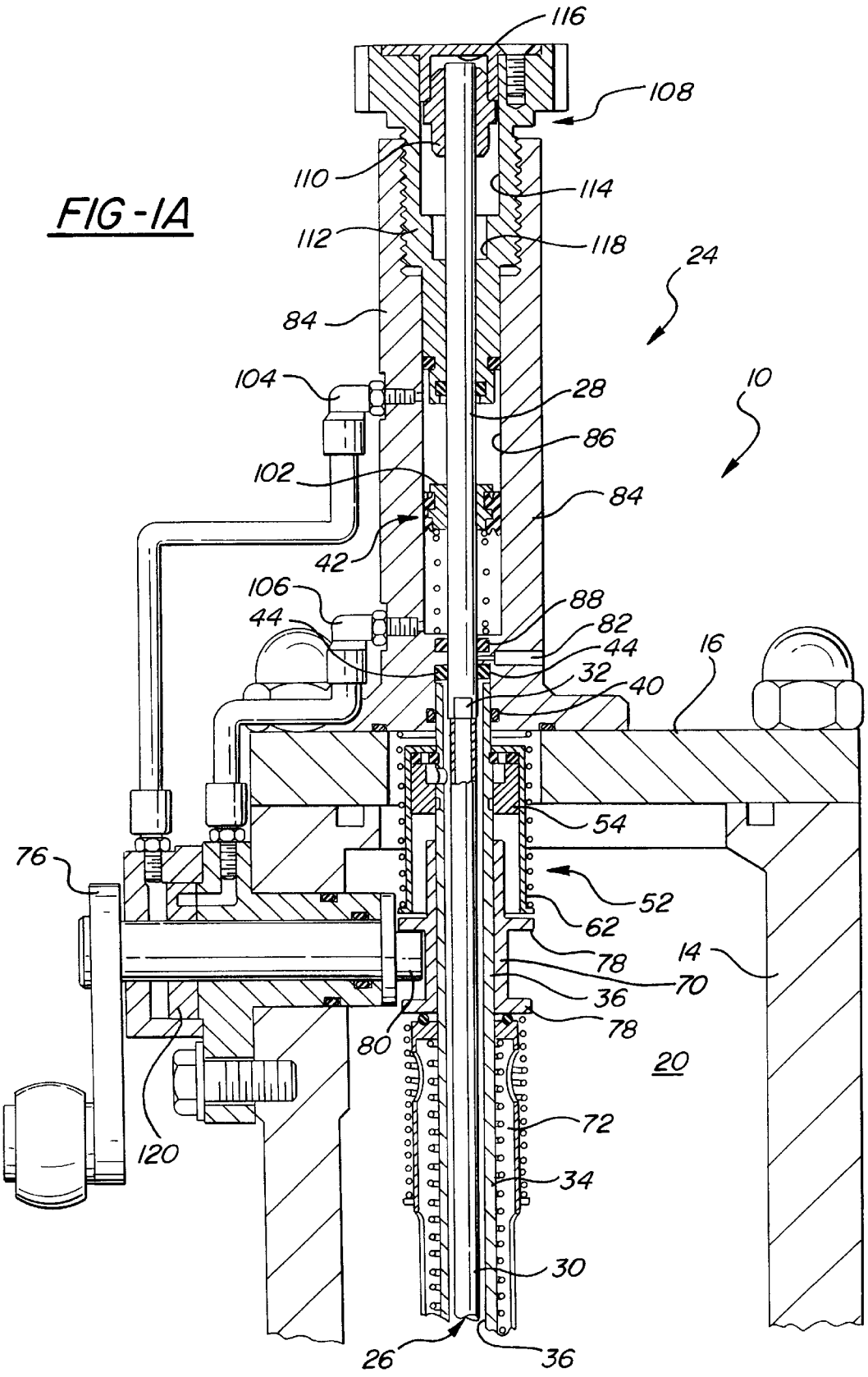
FIG. 1A is a partially cross-sectional view of a top half of a filling machine in a non-use position.
Figure 1B:
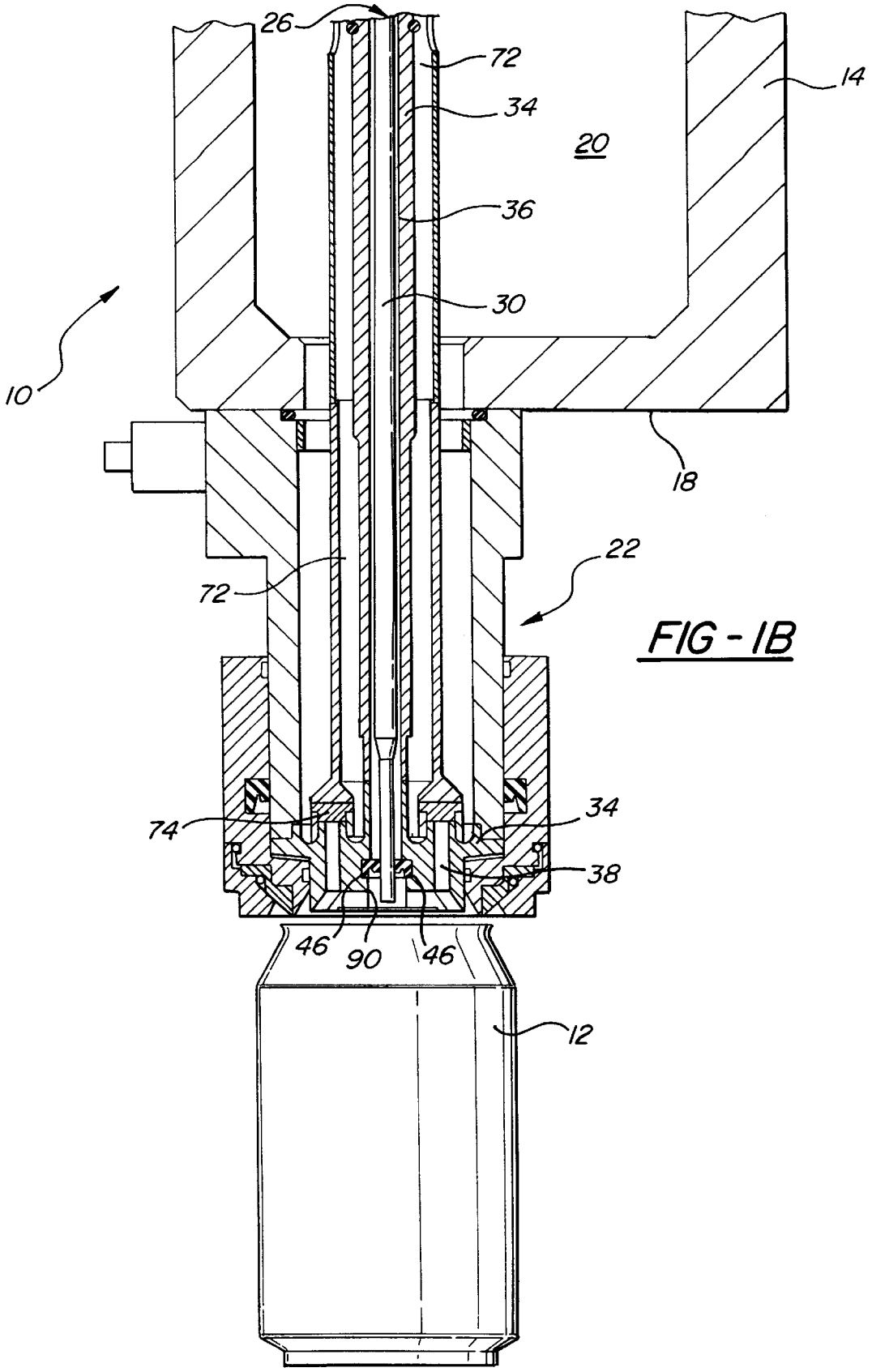
FIG. 1B is a partially cross-sectional view of a bottom half of the filling machine in the non-use position.
Figure 2A:
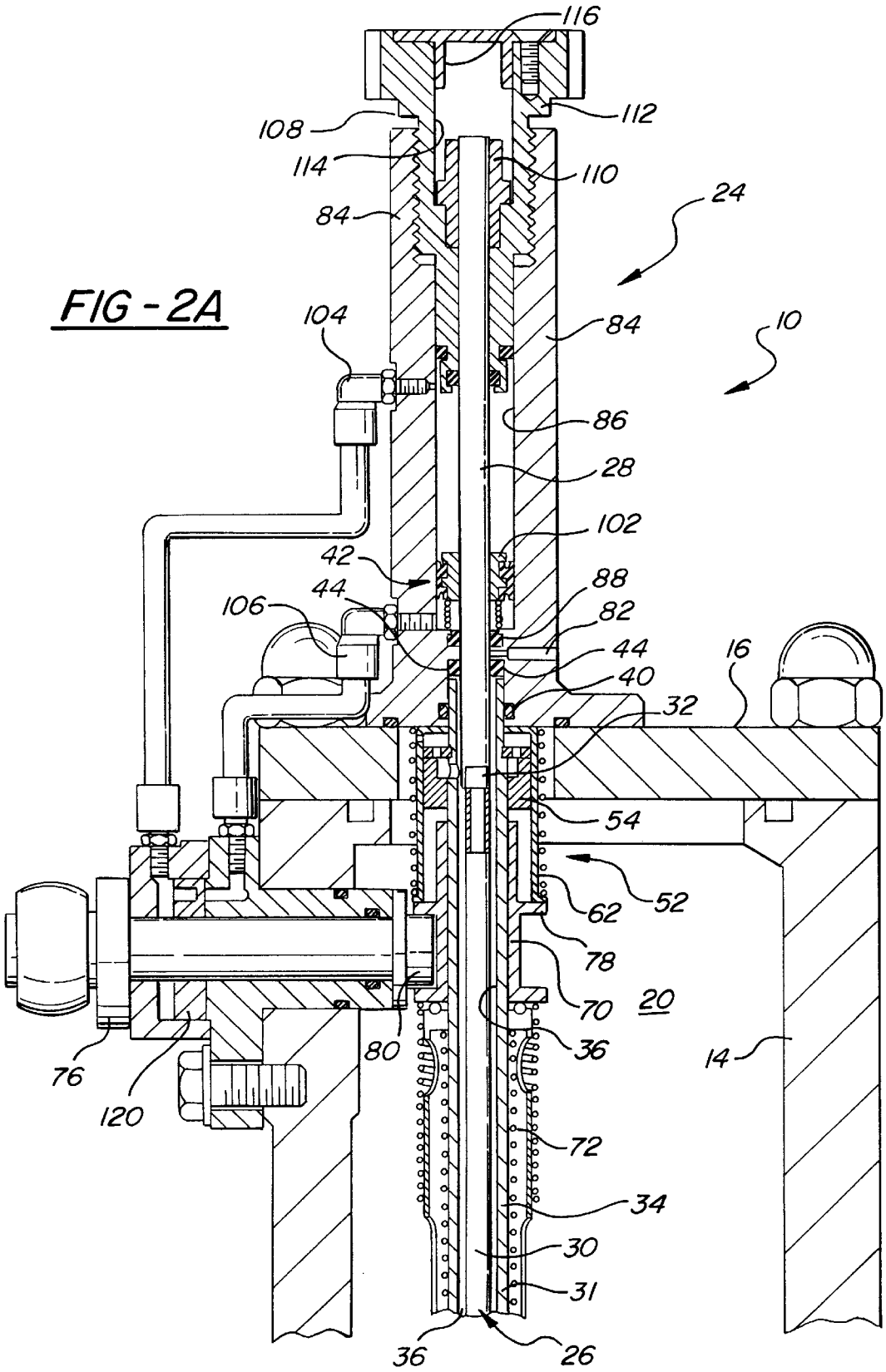
FIG. 2A is a partially cross-sectional view of the top half of the filling machine in a filling position.
Figure 2B:
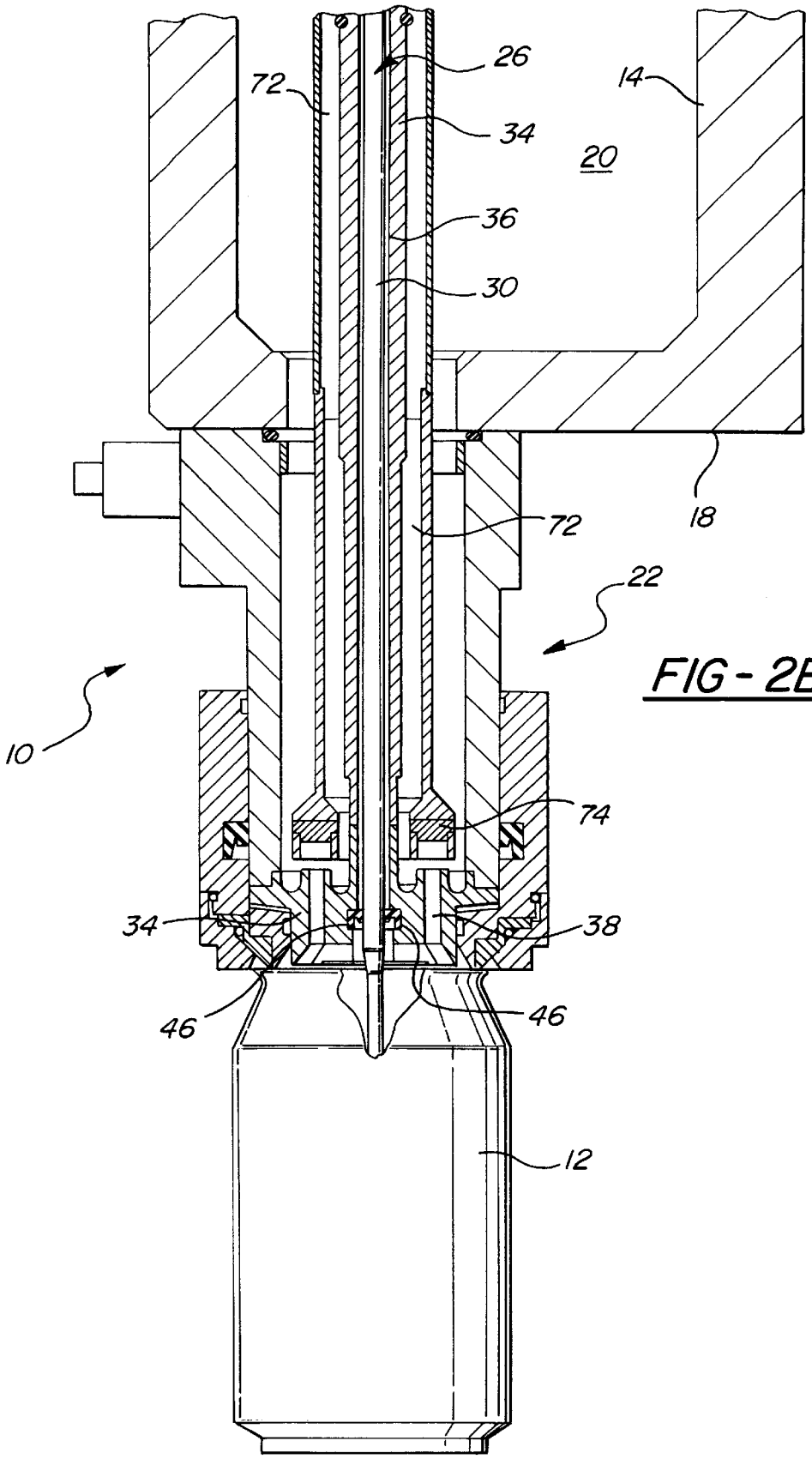
FIG. 2B is a partially cross-sectional view of the bottom half of the filling machine in the filling position.

Referring to the Figures, wherein like numerals indicate like or corresponding parts throughout the several views, a filling machine assembly for filling a container 12 with a fluid material (not shown) is generally shown at 10 in FIGS. 1A through 2B. For illustrative purposes, the filling machine 10 is split into two halves. A top half of the filling machine 10 is shown in FIGS. 1A and 2A and a bottom half of the filling machine 10 is shown in FIGS. 1B and 2B. FIGS. 3 through 6 show exploded features of the two halves. The figures illustrate the two operating positions of the filling machine 10. Specifically, FIGS. 1A, 1B, 3 and 4 show the filling machine 10 in a non-use position and FIGS. 2A, 2B, 5 and 6 show the filling machine 10 in a filling position. The subject filling machine 10 could fill any type of container 12, such as a can, jar, or bottle, with any type of fluid material, such as a carbonated drink, juice, water or the like, without deviating from the scope of the subject invention. The filling machine 10 shown in the figures is designed to fill the container 12 with a carbonated beverage. For illustrative purposes, the container 12 is depicted as a 12 oz can 12. The filling machine 10 is mounted to a filling mechanism (not shown) which typically includes a series of conveyors, tanks, and support platforms as are well known in the art.

The filling machine 10 assembly comprises a support housing 14 having an upper surface 16 and a lower surface 18 defining an inner fluid chamber 20 for supplying the fluid material to be discharged into the container 12. As appreciated by those skilled in the art, the fluid material, which is preferably a liquid beverage, fills a portion of the inner fluid chamber 20 while leaving a space above the liquid for a pressurized inert gas such as carbon dioxide or nitrogen. For illustrative purposes, supply and return pipes for the liquid and gas as well as the liquid and gas themselves are not shown. Also not shown are support members and a turntable for mounting the filling machine 10 to the filling mechanism. As discussed above and in the background section, the additional operating components of the filling machine 10 are known to those skilled in the art. A common storage tank (not shown) feeds the inner fluid chamber 20 with the required liquid and gas.

As generally shown in FIGS. 1B and 2B, a valve housing 22 is mounted to the lower surface 18 of the support housing 14 for controlling the discharge of the fluid material into the container 12. As generally shown in FIGS. 1A, 2A, 3 and 5, a control device 24 is mounted to the upper surface 16 of the support housing 14. The valve housing 22 and control device 24 are discussed in greater detail hereinbelow.

Figure 3:
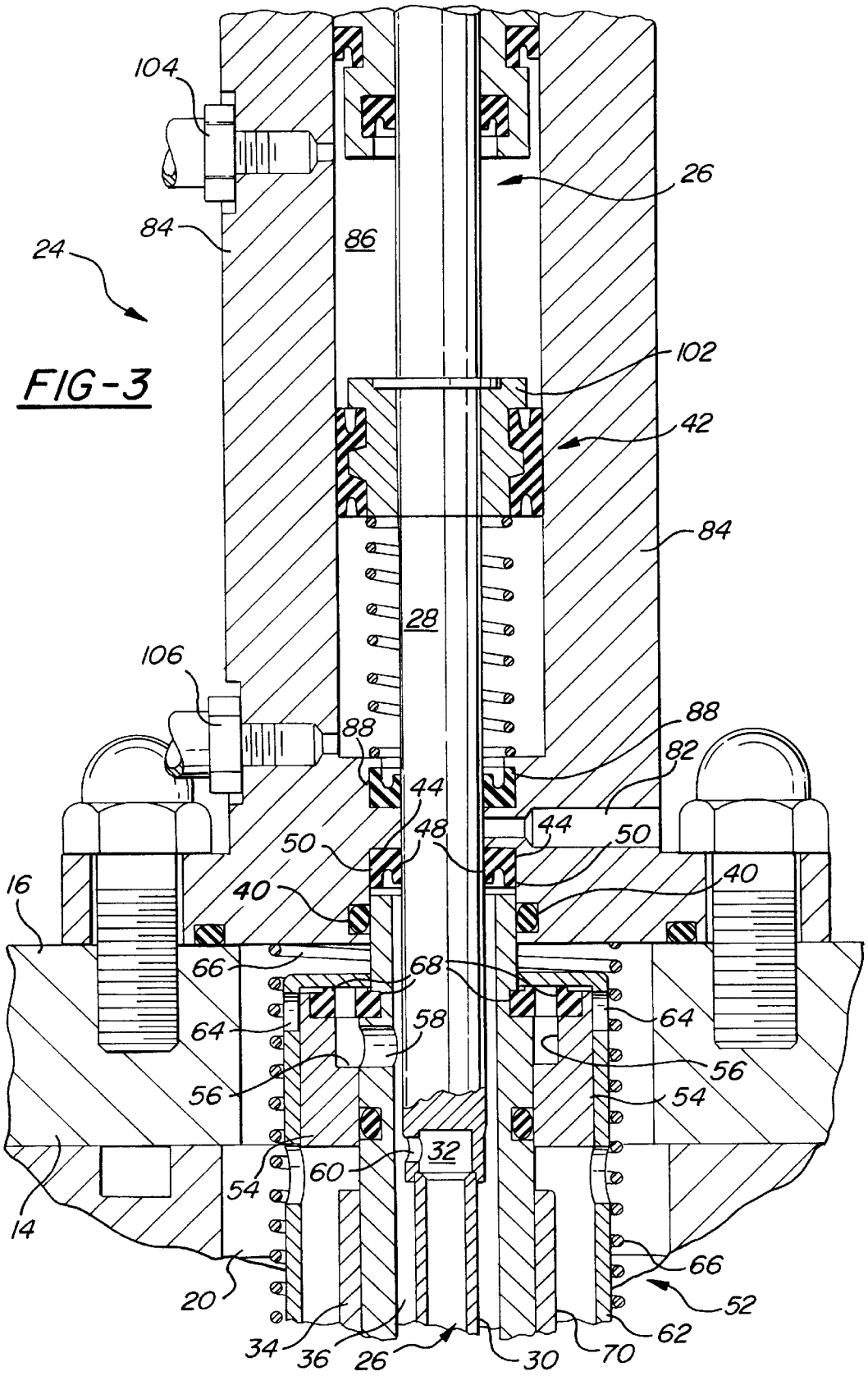
FIG. 3 is an exploded partially cross-sectional view of an interface between a control device and a support housing of the top half of the filling machine with the filling machine in the non-use position.
Figure 4:
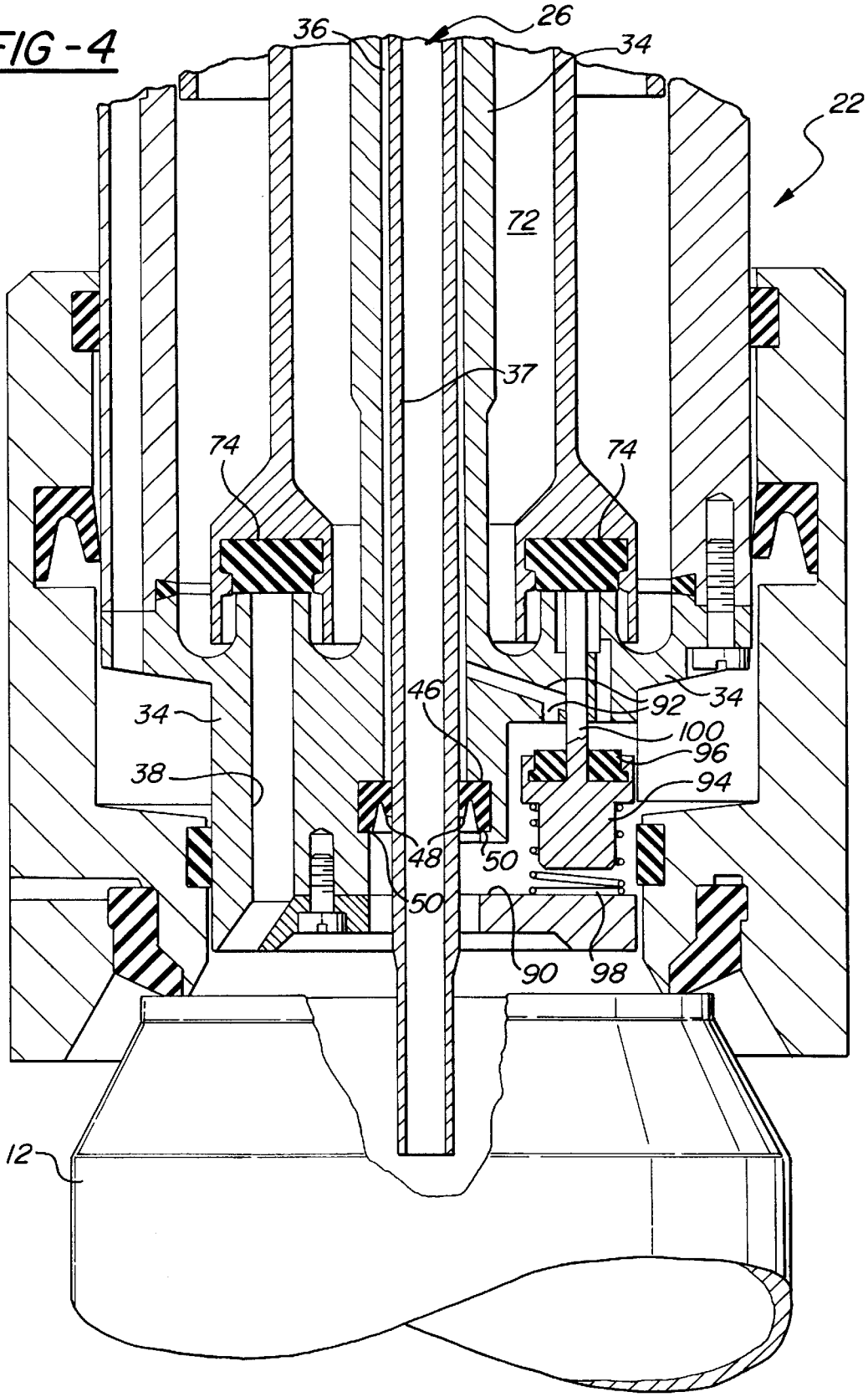
FIG. 4 is an exploded partially cross-sectional view of a valve housing of the bottom half of the filling machine with the filling machine in the non-use position.
Figure 5:
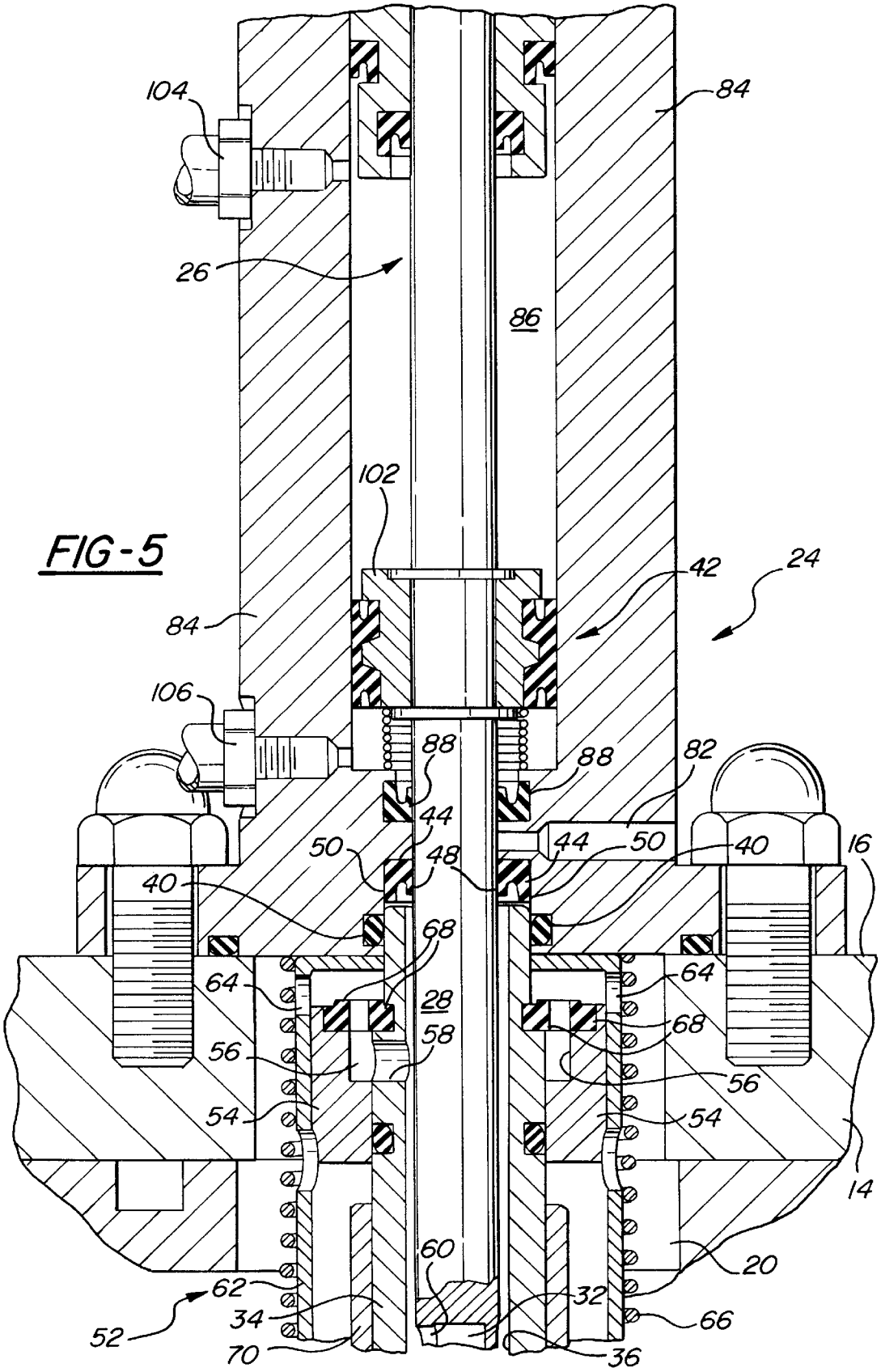
FIG. 5 is an exploded partially cross-sectional view similar to FIG. 3 but with the filling machine in the filling position.
Figure 6:
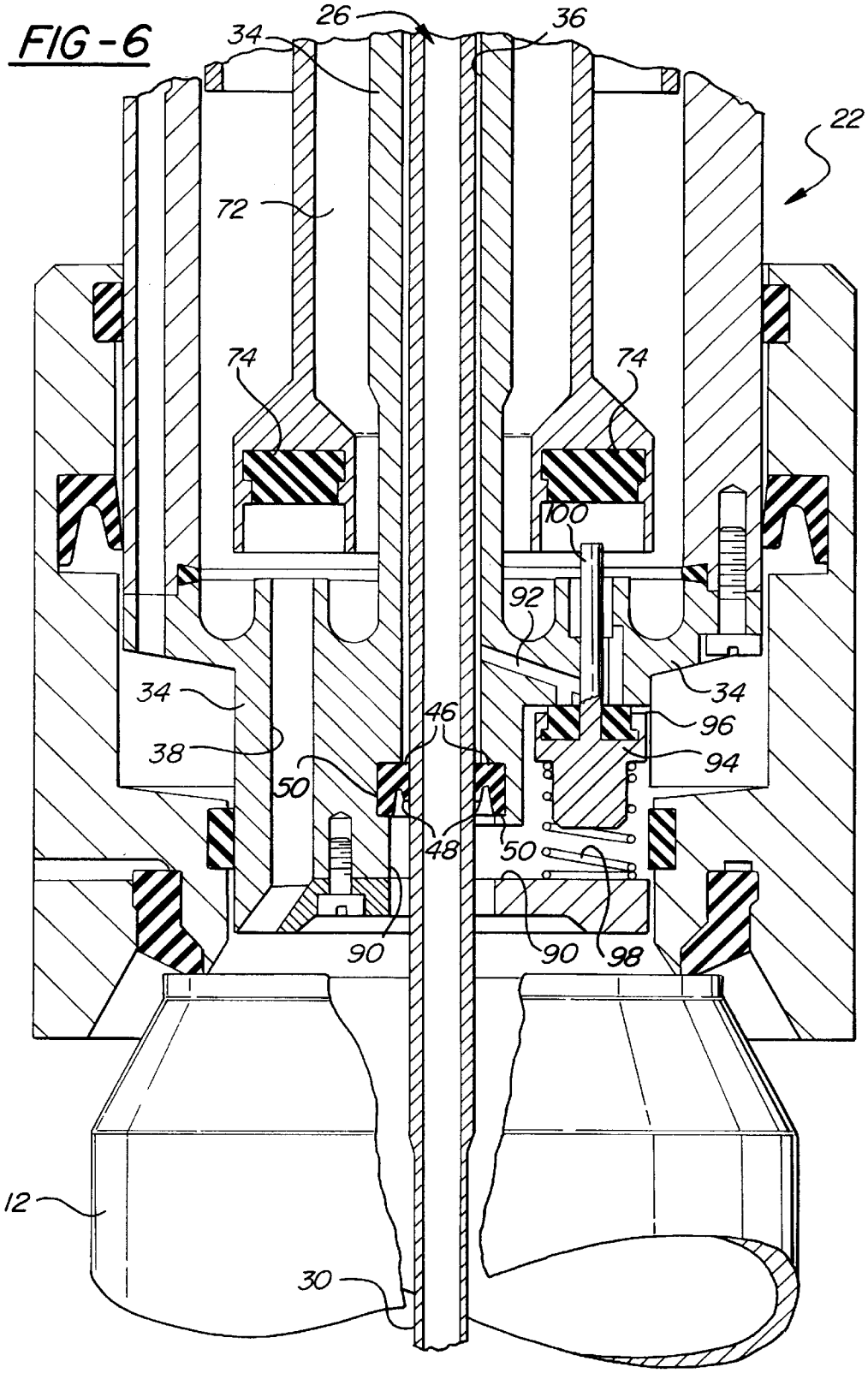
FIG. 6 is an exploded partially cross-sectional view similar to FIG. 4 but with the filling machine in the filling position.

A vent tube, generally shown at 26, has a first end disposed within the control device 24 and a second end extending into the valve housing 22. The vent tube 26 is at least partially hollow and moves upwardly and downwardly between the non-use and filling positions during the filling process. Referring also to FIG. 3, the vent tube 26 preferably has an upper portion 28 and a lower portion 30 with the two portions 28, 30 welded or otherwise affixed together such that the upper 28 and lower 30 portions operate as a single unit. The upper portion 28 is a solid pipe having a small hollow section 32. The upper portion 28 of the vent tube 26 is the only part of the vent tube 26 that extends into the control device 24. Referring also to FIGS. 4 and 6, the lower portion 30 is entirely hollow and tapers at the distal end thereof which is adjacent the second end of the vent tube 26. The hollow lower portion 30 is in fluid communication with the small hollow section 32 of the upper portion 28. The lower portion 30 is the only part of the vent tube 26 that extends into the valve housing 22.

A support tube 34 defines a through bore 36 extending between the control device 24 and the valve housing 22 and surrounding the vent tube 26. Referring to FIGS. 1B, 2B, 4 and 6, the support tube 34 has a lower portion which makes up part of the valve housing 22. The lower portion of the support tube 34 has at least one fluid passageway 38 for allowing the fluid material to pass from the inner fluid chamber 20 into the container 12 during the filling process. Referring to FIGS. 1A, 2A, 3 and 5, the support tube 34 is secured to the control device 24 by a support tube seal 40. The support tube seal 40 is disposed between the support tube 34 and the control device 24 for continuously sealing the bore 36 of the support tube 34 from the inner fluid chamber 20. The support tube 34 is thus mounted within the inner fluid chamber 20 by the control device 24 and valve housing 22. The support tube 34 must be rigid enough to withstand the operating pressures within the inner fluid chamber 20. The support tube 34 must also be securely fixed within the support housing 14 in order to support a number of working components as are later discussed.

An actuation device, generally shown at 42, moves the vent tube 26 within the bore 36 relative to the support tube 34 a predetermined stroke between the filling position and the non-use position. As illustrated, FIGS. 1A, 1B, 3 and 4 show the filling machine 10 in the non-use position and FIGS. 2A, 2B, 5, and 6 show the filling machine 10 in the filling position. The stroke of the vent tube 26 may be adjusted and is dependent upon the type of container 12 being filled. The actuation device 42 and movement of the vent tube 26 are discussed in greater detail below.

An upper tube seal 44 is in sealing engagement between the control device 24 and the first end of the vent tube 26 with the bore 36 of the support tube 34 being open to the upper seal 44. A lower tube seal 46 is in sealing engagement between the support tube 34 and the second end of the vent tube 26 to seal the bore 36 of the support tube 34 between the upper 44 and lower 46 seals.

As best shown in FIGS. 3 through 6, the upper 44 and lower 46 tube seals have a U-shaped configuration with a first leg 48 and a second leg 50 interconnected by a bottom. Preferably, the first leg 48 is shorter than the second leg 50 and continuously engages the vent tube 26. Even more preferably, the bottom of the upper tube seal 44 and a back side of the lower tube seal 46 faces the bore 36 of the support tube 34. For illustrative purposes, the bottom, back side and front side of the upper 44 and lower 46 tube seals are not numbered. It is to be understood that the front side of the tube seals 44, 46 include the bottom and first 48 and second 50 leg and the back side of the tube seals 44, 46 is substantially flat. As can be appreciated, when the vent tube 26 moves upward and downward significant stresses can be transferred to the first legs 48 of the upper 44 and lower 46 tube seals which can reduce the operating life of the tube seals 44, 46. Hence, it is critical to the subject invention that the operating pressures on both sides of the upper 44 and lower 46 tube seals be equalized. This equalization of pressures reduces the operating stresses on the upper 44 and lower 46 tube seals. Since the inner fluid chamber 20 operates under relatively high pressures, the upper 44 and lower 46 tube seals must be sealed off from the inner fluid chamber 20 when the vent tube 26 is moved upwardly and downwardly. A chamber sealing mechanism, generally shown at 52, for sealing the upper 44 and lower 46 tube seals from the inner fluid chamber 20 is the subject of the present invention and is now discussed in detail. As appreciated by those skilled in the art, the chamber sealing mechanism 52 may be of any suitable design or configuration so long as the operating pressures are equalized on both sides of the upper 44 and lower 46 tube seals.

As shown in FIGS. 1A, 2A, 3 and 5, the filling machine assembly 10 is characterized by the chamber sealing mechanism 52 which selectively seals the bore 36 between the upper 44 and lower 46 tube seals from the inner fluid chamber 20 to equalize operating pressures against the upper 44 and lower 46 tube seals during the movement of the vent tube 26 between the filling and non-use positions. As discussed above, the operating pressures within the inner fluid chamber 20 can be significant. Hence, the upper 44 and lower 46 tube seals must be sealed off from the inner fluid chamber 20. In other words, the bore 36 which fluidly connects the upper tube seal 44 and lower tube seal 46 to the inner fluid chamber 20 must be sealed.

The chamber sealing mechanism 52 of the preferred embodiment includes a seat 54 extending outwardly from the support tube 34. The seat 54 has an upper passageway 56, 58 for fluid communication between the bore 36 and the inner fluid chamber 20. Specifically, the upper passageway 56, 58 includes a channel 56 disposed within the seat 54 and an opening 58 through the support tube 34 for fluid communication between the bore 36 and the inner fluid chamber 20. The vent tube 26 includes an opening 60 for fluid communication between the hollow lower portion 30 of the vent tube 26 and the upper passageway 56, 58. The opening 60 within the vent tube 26 is preferably in fluid communication with the small hollow section 32 of the upper portion 28 of the vent tube 26. Accordingly, the hollow lower portion 30 of the vent tube 26 is in selective fluid communication with the inner fluid chamber 20.

The chamber sealing mechanism 52 also includes a moveable plate 62 having a closed position with the plate 62 in sealing engagement with the upper passageway 56, 58 of the seat 54 to close the upper passageway 56, 58 and seal the bore 36 and the upper 44 and lower 46 tube seals from the inner fluid chamber 20. The plate 62 also has an open position with the plate 62 in spaced relationship from the upper passageway 56, 58 of the seat 54 to open the bore 36 and the upper 44 and lower 46 tube seals to the inner fluid chamber 20. A plurality of holes 64 are disposed within the plate 62 to complete the selective fluid connection between the vent tube 26 and the inner fluid chamber 20. This fluid communication is necessary for the operation of the filling machine 10 as is discussed in the operation section below. A plate spring 66 engages the control device 24 at a first end and the plate 62 at a second end to continuously bias the plate 62 into the closed position. A pair of ring seals 68 are disposed on the support tube 34 and the seat 54 above the upper passageway 56, 58 for selective sealing engagement with the plate 62 as the plate 62 moves between the open and closed positions. Specifically, the plate 62 has a top portion disposed above the holes 64 which is bent inwardly toward the support tube 34. Preferably, the top portion of the plate 62 engages the ring seals 68.

Referring to FIGS. 1A and 2A, an actuation bracket 70 is slideably disposed on the support tube 34 for selective engagement with the plate 62 of the chamber sealing mechanism 52 to move the plate 62 against the bias of the plate spring 66 to the open position. The plate 62 can be moved upwardly against the control device 24 or any position between the control device 24 and ring seals 68 as is desired. A fluid sealing mechanism 72 is mounted to the actuation bracket 70 and is movably mounted with respect to the support tube 34 for controlling the discharge of fluid material. Referring to FIGS. 1B and 2B, the fluid sealing mechanism 72 selectively seals with the fluid passageway 38 of the support tube 34 to control the flow of the fluid material. The fluid sealing mechanism 72 is a relatively large tube having a number of openings. The distal end of the fluid sealing mechanism 72 is enlarged in order to retain a liquid seal 74 to effectuate the sealing engagement with the fluid passageway 38. As appreciated by those skilled in the art, the valve housing 22 and fluid sealing mechanism 72 include many additional components to effectuate the operation of the filling process, some of which are not shown. These additional components are not discussed in any greater detail and are well known in the beverage filling art.

An actuation lever 76 is mounted within the support housing 14 and engages the actuation bracket 70 for manipulating the bracket 70 along with the fluid sealing mechanism 72 between an open position, which corresponds to the open position of the plate 62, to discharge the fluid material through the valve housing 22 and a closed position, which corresponds to the closed position of the plate 62, to seal the support housing 14 from the valve housing 22. Preferably, the actuation bracket 70 includes a pair of outwardly projecting annular flanges 78. An upper annular flange 78 selectively engages the plate 62 and a lower annular flange 78 is secured to the fluid sealing mechanism 72. The actuation lever 76 includes an oval cam 80 which engages the actuation bracket 70 between the annular flanges 78. The actuation lever 76 is also operatively connected to the actuation device 42 the operation of which will be discussed in greater detail below.

Referring back to FIGS. 3 and 5, the support tube seal 40, disposed between the support tube 34 and the control device 24, continuously seals the upper tube seal 44 from the inner fluid chamber 20. Hence, when the plate 62 is in the closed position, the upper tube seal 44 can now be sealed off from the inner fluid chamber 20.

An air port 82 is disposed above the upper tube seal 44 and the support tube 34 to equalize operating pressures above the upper tube seal 44 with operating pressures within the bore 36. Specifically, the air port 82 is an opening extending entirely through the control device 24 to the vent tube 26. The air port 82 provides a means to control the operating pressure on the back side of the upper tube seal 44. The upper tube seal 44 now has the air port 82 on the back side and the sealed bore 36 on the front side. Accordingly, the upper tube seal 44 has operating pressures on both sides of the seal 44 which can be easily controlled.

The control device 24 includes outer walls 84 defining a working chamber 86 having a top and a bottom. A chamber tube seal 88 is mounted within the control device 24 above the air port 82 and below the bottom of the working chamber 86 to seal the working chamber 86 from the air port 82. The chamber tube seal 88 is preferably of the same design as the upper 44 and lower 46 tube seals. A bottom of the chamber tube seal 88 faces the working chamber 86. Preferably, the upper 44, lower 46, and chamber 88 tube seals support and guide the vent tube 26 within the support tube 34 between the filling and non-use positions. In other words, the vent tube 26 does not directly engage the support tube 34.

Referring to FIGS. 4 and 6, a lower passageway 90 is disposed below the lower tube seal 46 and the support tube 34 to equalize operating pressures below the lower tube seal 46 with operating pressures within the bore 36. Specifically, the lower passageway 90 is a cavity formed within the support tube 34. As shown, the bottom of the lower tube seal 46 faces the lower passageway 90. The lower passageway 90 operates in a similar manner as the air port 82. In other words, the lower passageway 90 provides a means to control the operating pressure on the front side of the lower tube seal 46. The lower tube seal 46 now has the sealed bore 36 on the back side and the lower passageway 90 on the front side. Accordingly, the lower tube seal 46 has operating pressures on both sides of the seal 46 which can also be easily controlled.

Preferably, the operating pressures around the tube seals 44, 46 are atmospheric which reduces frictional stresses against the upper 44 and lower 46 tube seals during the movement of the vent tube 26 between the filling and non-use positions. To partially facilitate the atmospheric condition around the tube seals 44, 46, the air port 82 and lower passageway 90 are open to the atmosphere. This creates an atmospheric condition on the back side of the upper tube seal 44 and on the front side of the lower tube seal 46. As appreciated, when the plate 62 seals off the bore 36 from the inner fluid chamber 20, the bore 36 retains the high pressure of the inner fluid chamber 20. Hence, there must be a device to release the pressure within the bore 36 which would create an atmospheric condition on the front side of the upper tube seal 44 and on the back side of the lower tube seal 46. This will equalize the pressure on both sides of the upper 44 and lower 46 tube seals once the bore 36 is sealed from the inner fluid chamber 20.

A pressure release passageway 92 is disposed between the bore 36 and the lower passageway 90 to selectively release operating pressures within the bore 36 to the lower passageway 90. Accordingly, the pressure within the bore 36 can be reduced to atmospheric pressure. A moveable stopper 94 has an open position, which corresponds to the closed position of the plate 62 and fluid sealing mechanism 72, with the stopper 94 in spaced relationship to the pressure release passageway 92 to open the bore 36 to the lower passageway 90. The stopper 94 also has a closed position, which corresponds to the open position of the plate 62 and fluid sealing mechanism 72, with the stopper 94 in sealing engagement with the pressure release passageway 92 to seal the bore 36 from the lower passageway 90. The pressure release passageway 92, stopper 94 and related components are specifically shown in FIGS. 4 and 6. FIGS. 1B and 2B disclose a different cross-sectional view of the valve housing 22 which does not shown these elements. A seal 96 is disposed on the stopper 94 for sealing engagement with the pressure release passageway 92. A stopper spring 98 engages the valve housing 22 at a first end and the stopper 94 at a second end to continuously bias the stopper 94 to the closed position.

A post 100 extends upwardly from the stopper 94 for engagement with the fluid sealing mechanism 72 to move the stopper 94 against the bias of the stopper spring 98 to the open position. In other words, as the fluid sealing mechanism 72 moves downwardly to seal the fluid passageway 38 of the support tube 34. The seal 74 of the fluid sealing mechanism 72 engages the post 100 and pushes the stopper 94 out of engagement with the pressure release passageway 92. Conversely, as the fluid sealing mechanism 72 moves upwardly to allow fluid material to flow through the fluid passageway 38 the stopper spring 98 moves the stopper 94 upwardly into sealing engagement with the pressure release passageway 92.

Referring back to FIGS. 1A, 2A, 3 and 5, the actuation device 42 is now discussed in greater detail. The actuation device 42 includes a piston 102 secured to the upper portion 28 of the vent tube 26 within the working chamber 86 for moving the vent tube 26 along the stroke between the filling and non-use positions. The actuation device 42 further includes a first input port 104 disposed above the piston 102 at the top of the working chamber 86 and a second input port 106 disposed below the piston 102 at the bottom of the working chamber 86 whereby a fluid medium may pass through the first 104 and second 106 input ports to move the piston 102 and the vent tube 26 along the stroke between the filling and non-use positions. The fluid medium passing through the first 104 and second 106 input ports is controlled by the actuation lever 76. The specifics of the actuation device 42 form the subject matter of an independent invention disclosed and claimed in co-pending application Ser. No. 09/273,188 filed concurrently herewith and assigned to the assignee hereof.

Referring to FIGS. 1A and 2A, the control device 24 also includes an adjustment mechanism, generally shown at 108, for adjusting the position of the predetermined stroke. The adjustment mechanism 108 includes a stop block 110 mounted adjacent the first end of the vent tube 26 and an adjustment nut 112 movably engaging the outer walls 84 and slideably supporting the stop block 110 for repositioning the stop block 110 and the filling position upon movement of the adjustment nut 112 thereby adjusting the position of the predetermined stroke. Preferably, the stop block 110 is mounted to the upper portion 28 of the vent tube 26 above the actuation device 42. The adjustment nut 112 includes an inner chamber 114 with the adjustment nut 112 slideably supporting the stop block 110 within the inner chamber 114. The inner chamber 114 includes an upper abutment 116 and a lower abutment 118 for selective engagement by the stop block 110 during the movement of the vent tube 26. The upward and downward position of the stroke of the vent tube 26 can be easily and incrementally controlled by the actuation of the adjustment nut 112. In other words, the desired position of the adjustment nut 112 defines the predetermined stroke of the vent tube 26. As appreciated, the movement of the adjustment nut 112 does not affect the distance that the vent tube 26 moves between the filling and non-use positions, i.e., the stroke itself. The specifics of the adjustment mechanism 108 form the subject matter of an independent invention disclosed and claimed in co-pending application Ser. No. 09/272,446 filed concurrently herewith and assigned to the assignee hereof.

During operation of the filling machine 10, the container 12 moves along a conveyor (not shown) into position below the valve housing 22. The container 12 is then moved into sealing engagement with the valve housing 22 and the vent tube 26 lowers into the filling position as shown in FIGS. 2A, 2B, 5 and 6. Specifically, the vent tube 26 is lowered due to actuation of the actuation lever 76. More specifically, the actuation lever 76 turns an air distribution disc 120 which directs pressurized air into the first input port 104 which pushes the piston 102 downwardly. This in turn pushes the vent tube 26 downwardly until the stop block 110 engages the lower abutment 118 within the inner chamber 114 of the adjustment nut 112. The container 12 is purged with the inert gas from the inner fluid chamber 20 in order to flush air and other impurities from the container 12. This is necessary to reduce the possibility of undesirable odors and ineffective filling of the container 12. The actuation lever 76 also lifts the actuation bracket 70 and fluid sealing mechanism 72 to the open position. The upward movement of the actuation bracket 70 pushes upwardly on the plate 62 to open the fluid communication between the vent tube 26 and the inner fluid chamber 20. The upward movement of the fluid sealing mechanism 72 opens the liquid passageway 38 and allows the stopper 94 to move into the closed position sealed over the pressure release passageway 92. As appreciated, the movement of the actuation lever 76, air distribution disc 120, vent tube 26, actuation bracket 70, fluid sealing mechanism 72, plate 62, and stopper 94 is for all practical purposes one simultaneous movement of the filling machine 10 from the non-use position to the filling position.

The liquid can now flow from the inner fluid chamber 20 and into the container 12 while the inert gas within the container 12 vents through the vent tube 26 into the top of the inner fluid chamber 20. Specifically, the gas flows from the container 12 into the hollow lower portion of the vent tube 26, through the small hollow section 32 of the upper portion 28 of the vent tube 26, through the opening 60 in the vent tube 26, through the opening 58 in the support tube 34, up through the channel 56 in the seat 54, through the holes 64 in the plate 62, and into the space above the liquid within the inner fluid chamber 20. The gas pressure in the container 12 and the inner fluid chamber 20 are equalized during the filling process which allows the liquid to flow into the container 12 solely under the influence of gravity. This type of filling procedure is very efficient and reduces the possibility of the beverage foaming.

After the container 12 is filled to the desired level, the actuation lever 76 is actuated to the non-use position as shown in FIGS. 1A, 1B, 3 and 4. Specifically, the air distribution disc 120 directs pressurized air into the second input port 106 to move the piston 102 upwardly. This also moves the vent tube 26 upwardly until the stop block 110 engages the upper abutment 116 of the inner chamber 114 of the adjustment nut 112. The actuation lever 76 moves the actuation bracket 70 downwardly which reengages the plate 62 with the seat 54 to seal the upper passageway 56, 58. This in turn seals the bore 36 from the inner fluid chamber 20. The downward movement of the actuation bracket 70 moves the fluid sealing mechanism 72 into sealing engagement with the valve housing 22, i.e., the closed position. The downward movement of the fluid sealing mechanism 72 pushes the stopper 94 downward and opens the pressure release passageway 92. Hence, the pressure within the bore 36 is released to the atmosphere. Accordingly, the atmospheric pressure is equalized on both sides of the upper 44 and lower 46 tube seals. As appreciated, the atmospheric pressure is equalized before the vent tube 26 moves upwardly to the non-use position. As discussed above, the movement of the actuation lever 76, air distribution disc 120, vent tube 26, actuation bracket 70, fluid sealing mechanism 72, plate 62, and stopper 94 is for all practical purposes one simultaneous movement of the filling machine 10 from the filling position back to the non-use position. Finally, gas is released from the top of the container 12 to the atmosphere as is well known in the art. The container 12 is transported away from the filling machine 10 via a conveyor (not shown) and the filling machine 10 is now ready to repeat the above described filling operation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be any way limiting, the invention may be practiced otherwise than as specifically described.

What is claimed is:

1. A filling machine assembly (10) for filling a container (12) with a fluid material, said assembly comprising:

a support housing (14) having an upper surface (16) and a lower surface (18) defining an inner fluid chamber (20) for supplying the fluid material to be discharged into the container (12);

a valve housing (22) mounted to said lower surface (18) of said support housing (14) for controlling the discharge of the fluid material;

a control device (24) mounted to said upper surface (16) of said support housing (14);

a vent tube (26) having a first end disposed within said control device (24) and a second end extending into said valve housing (22);

a support tube (34) defining a through bore (36) extending between said control device (24) and said valve housing (22) and surrounding said vent tube (26);

an actuation device (42) for moving said vent tube (26) within said bore (36) relative to said support tube (34) a predetermined stroke between a filling position and a non-use position;

an upper tube seal (44) in sealing engagement between said control device (24) and said first end of said vent tube (26), said bore (36) of said support tube (34) being open to said upper seal (44); and a lower tube seal (46) in sealing engagement between said support tube (34) and said second end of said vent tube (26) to seal said bore (36) of said support tube (34) between said upper (44) and lower (46) seals;

said assembly characterized by a chamber sealing mechanism (52) for selectively sealing said bore (36) between said upper (44) and lower (46) tube seals from said inner fluid chamber (20) to equalize operating pressures against said upper (44) and lower (46) tube seals during said movement of said vent tube (26) between said filling and non-use positions.

2. An assembly as set forth in claim 1 wherein said chamber sealing mechanism (52) includes a seat (54) extending outwardly from said support tube (34), said seat (54) having an upper passageway (56,58) for fluid communication between said bore (36) and said inner fluid chamber (20).

3. An assembly as set forth in claim 2 wherein said chamber sealing mechanism (52) includes a moveable plate (62) having a closed position with said plate (62) in sealing engagement with said upper passageway (56,58) of said seat (54) to close said upper passageway (56,58) and seal said bore (36) and said upper (44) and lower (46) tube seals from said inner fluid chamber (20) and an open position with said plate (62) in spaced relationship from said upper passageway (56,58) of said seat (54) to open said bore (36) and said upper (44) and lower (46) tube seals to said inner fluid chamber (20).

4. An assembly as set forth in claim 3 wherein said upper passageway (56,58) includes a channel (56) disposed within said seat (54) and an opening (58) through said support tube (34) for fluid communication between said bore (36) and said inner fluid chamber (20).

5. An assembly as set forth in claim 4 wherein said vent tube (26) includes an opening (60) for fluid communication between said vent tube (26) and said inner fluid chamber (20).

6. An assembly as set forth in claim 3 further including a plate spring (66) engaging said control device (24) at a first end and said plate (62) at a second end to continuously bias said plate (62) into said closed position.

7. An assembly as set forth in claim 6 further including an actuation bracket (70) slideably disposed on said support tube (34) for selective engagement with said plate (62) of said chamber sealing mechanism (52) to move said plate (62) against said bias of said plate spring (66) to said open position.

8. An assembly as set forth in claim 7 further including a pair of ring seals (68) disposed on said support tube (34) and said seat (54) above said upper passageway (56,58) for selective sealing engagement with said plate (62) as said plate (62) moves between said open and closed positions.

9. An assembly as set forth in claim 8 further including a support tube seal (40) disposed between said support tube (34) and said control device (24) for continuously sealing said upper tube seal (44) from said inner fluid chamber (20).

10. An assembly as set forth in claim 7 further including a fluid sealing mechanism (72) mounted to said actuation bracket (70) and movably mounted with respect to said support tube (34) for controlling the discharge of fluid material.

11. An assembly as set forth in claim 10 further including an actuation lever (76) mounted within said support housing (14) and engaging said actuation bracket (70) for manipulating said bracket (70) along with said fluid sealing mechanism (72) between an open position, which corresponds to said open position of said plate (62), to discharge the fluid material through said valve housing (22) and a closed position, which corresponds to said closed position of said plate (62), to seal said support housing (14) from said valve housing (22).

12. An assembly as set forth in claim 1 further including an air port (82) disposed above said upper tube seal (44) and said support tube (34) to equalize operating pressures above said upper tube seal (44) with operating pressures within said bore (36).

13. An assembly as set forth in claim 12 further including a lower passageway (90) disposed below said lower tube seal (46) and said support tube (34) to equalize operating pressures below said lower tube seal (46) with operating pressures within said bore (36).

14. An assembly as set forth in claim 13 wherein said operating pressures are atmospheric which reduces frictional stresses against said upper (44) and lower (46) tube seals during said movement of said vent tube (26) between said filling and non-use positions.

15. An assembly as set forth in claim 13 further including a pressure release passageway (92) between said bore (36) and said lower passageway (90) to selectively release operating pressures within said bore (36) to said lower passageway (90).

16. An assembly as set forth in claim 15 further including a moveable stopper (94) having an open position with said stopper (94) in spaced relationship to said pressure release passageway (92) to open said bore (36) to said lower passageway (90) and a closed position with said stopper (94) in sealing engagement with said pressure release passageway (92) to seal said bore (36) from said lower passageway (90).

17. An assembly as set forth in claim 16 further including a stopper spring (98) engaging said valve housing (22) at a first end and said stopper (94) at a second end to continuously bias said stopper (94) to said closed position.

18. An assembly as set forth in claim 17 further including a fluid sealing mechanism (72) movably mounted with respect to said support tube (34) for controlling the discharge of fluid material.

19. An assembly as set forth in claim 18 further including a post (100) extending upwardly from said stopper (94) for engagement with said fluid sealing mechanism (72) to move said stopper (94) against said bias of said stopper spring (98) to said open position.

20. An assembly as set forth in claim 13 wherein said control device (24) includes outer walls (84) defining a working chamber (86) having a top and a bottom.

21. An assembly as set forth in claim 20 further including a chamber tube seal (88) mounted within said control device (24) above said air port (82) and below said bottom of said working chamber (86) to seal said working chamber (86) from said air port (82).

22. An assembly as set forth in claim 21 wherein said upper (44), lower (46), and chamber (88) tube seals support and guide said vent tube (26) within said support tube (34) between said filling and non-use positions.

23. An assembly as set forth in claim 21 wherein said actuation device (42) includes a piston (102) secured to said vent tube (26) within said working chamber (86) for moving said vent tube (26) along said stroke between said filling and non-use positions.

24. An assembly as set forth in claim 23 wherein said actuation device (42) further includes a first input port (104) disposed above said piston (102) at said top of said working chamber (86) and a second input port (106) disposed below said piston (102) at said bottom of said working chamber (86) whereby a fluid medium may pass through said first (104) and second (106) input ports to move said piston (102) and said vent tube (26) along said stroke between said filling and non-use positions.

25. An assembly as set forth in claim 24 wherein said control device (24) includes an adjustment mechanism (108) for adjusting the position of said predetermined stroke.

26. An assembly as set forth in claim 25 wherein said adjustment mechanism (108) includes a stop block (110) mounted adjacent said first end of said vent tube (26) and an adjustment nut (112) movably engaging said outer walls (84) and slideably supporting said stop block (110) for repositioning said stop block (110) and said filling position upon movement of said adjustment nut (112) thereby adjusting said position of said predetermined stroke.

* * * * *